US010714246B2

(12) United States Patent
Lee et al.

(10) Patent No.: US 10,714,246 B2
(45) Date of Patent: Jul. 14, 2020

(54) RARE EARTH PERMANENT MAGNET AND METHOD FOR MANUFACTURING THEREOF

(71) Applicant: HYUNDAI MOTOR COMPANY, Seoul (KR)

(72) Inventors: Jae-Ryung Lee, Hwaseong-si (KR); Kun-Min Park, Suwon-si (KR); Hyung-Ju Lee, Gimhae-si (KR); Yeon-Jun Jung, Seoul (KR)

(73) Assignee: Hyundai Motor Company, Seoul (KR)

( * ) Notice: Subject to any disclaimer, the term of this patent is extended or adjusted under 35 U.S.C. 154(b) by 615 days.

(21) Appl. No.: 14/887,062

(22) Filed: Oct. 19, 2015

(65) Prior Publication Data

US 2016/0203892 A1 Jul. 14, 2016

(30) Foreign Application Priority Data

Jan. 9, 2015 (KR) ..... 10-2015-0003336

(51) Int. Cl.
*H01F 41/02* (2006.01)
*H01F 1/057* (2006.01)
(Continued)

(52) U.S. Cl.
CPC ..... *H01F 1/0577* (2013.01); *B22F 3/10* (2013.01); *B22F 3/26* (2013.01); *B22F 5/00* (2013.01);
(Continued)

(58) Field of Classification Search
None
See application file for complete search history.

(56) References Cited

U.S. PATENT DOCUMENTS

2009/0226339 A1* 9/2009 Nakamura ..... B22F 3/24 419/9
2010/0119703 A1* 5/2010 Sagawa ..... C22C 33/0278 427/127
(Continued)

FOREIGN PATENT DOCUMENTS

CN 102768898 A 5/1995
CN 101317238 A 12/2008
(Continued)

*Primary Examiner* — Xiaowei Su
(74) *Attorney, Agent, or Firm* — Morgan, Lewis & Bockius LLP

(57) ABSTRACT

A method for manufacturing a rare earth permanent magnet includes manufacturing an NdFeB sintered magnet. A grain boundary diffusion material in the form of a mixed powder comprising an alloy powder containing $Re^1{}_aM_b$ or M; and $Re^2$ hydride or $Re^2$ fluoride is disposed on a surface of the NdFeB sintered magnet. The grain boundary diffusion material is heated to diffuse at least one of $Re^1$, $Re^2$ and M into a grain boundary part inside the sintered magnet or a grain boundary part region of a sintered magnet main phase grain. $Re^1$ and $Re^2$ are each rare earth elements selected from the group consisting of dysprosium, terbium, neodymium, praseodymium, and holmium, M is a metal compound consisting of copper, zinc, tin, and aluminum, $0.1<a<99.9$, and $a+b=100$.

5 Claims, 1 Drawing Sheet

(51) Int. Cl.

| | |
|---|---|
| ***B22F 9/04*** | (2006.01) |
| ***C22C 38/10*** | (2006.01) |
| ***C22C 38/06*** | (2006.01) |
| ***C22C 38/16*** | (2006.01) |
| ***C22C 38/00*** | (2006.01) |
| ***B22F 3/10*** | (2006.01) |
| ***B22F 3/26*** | (2006.01) |
| ***B22F 5/00*** | (2006.01) |
| *B22F 3/24* | (2006.01) |

(52) U.S. Cl.
CPC ..... *C22C 38/002* (2013.01); *C22C 38/005* (2013.01); *C22C 38/06* (2013.01); *C22C 38/10* (2013.01); *C22C 38/16* (2013.01); *H01F 41/0293* (2013.01); *B22F 2003/248* (2013.01); *B22F 2998/10* (2013.01); *B22F 2999/00* (2013.01); *C22C 2202/02* (2013.01)

(56) References Cited

U.S. PATENT DOCUMENTS

2010/0282371 A1* 11/2010 Sagawa ..... H01F 1/0557 148/302
2012/0280775 A1* 11/2012 Nagata ..... B22F 3/24 335/302
2013/0181039 A1* 7/2013 Obata ..... C22C 38/002 228/194
2013/0271248 A1* 10/2013 Nagata ..... H01F 1/0311 335/302
2014/0290803 A1* 10/2014 Kato ..... H01F 1/0577 148/302

FOREIGN PATENT DOCUMENTS

| | | | |
|---|---|---|---|
| CN | 101375352 | A | 2/2009 |
| CN | 103140902 | A | 6/2013 |
| CN | 104078176 | A | 10/2014 |
| CN | 104752049 | A | 7/2015 |
| JP | 2006-179963 | A | 7/2006 |
| JP | 2009-170541 | A | 7/2009 |
| JP | 2011-159983 | | 8/2011 |
| JP | 2011-223007 | A | 11/2011 |
| JP | 2012-174920 | A | 9/2012 |
| JP | 2013-153172 | A | 8/2013 |
| JP | 2013-191849 | A | 9/2013 |
| JP | 2014-063997 | A | 4/2014 |
| KR | 10-2012-0124039 | A | 11/2012 |
| KR | 10-1397328 | B1 | 5/2014 |

* cited by examiner

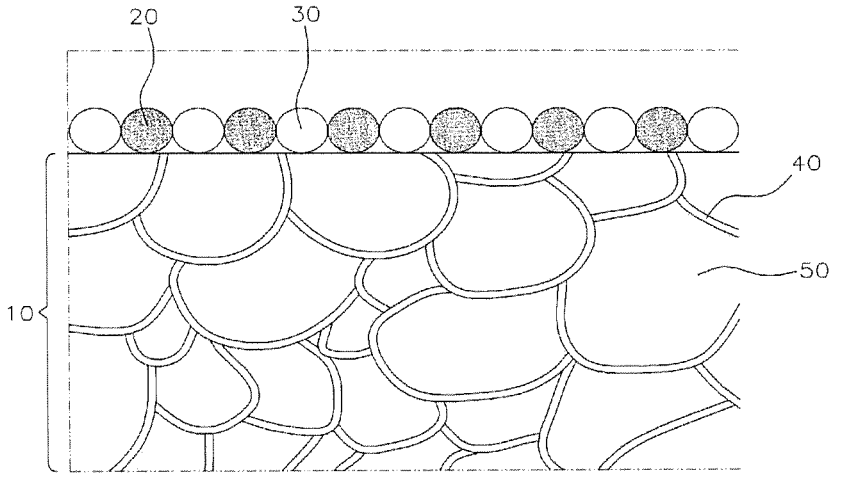
(a)
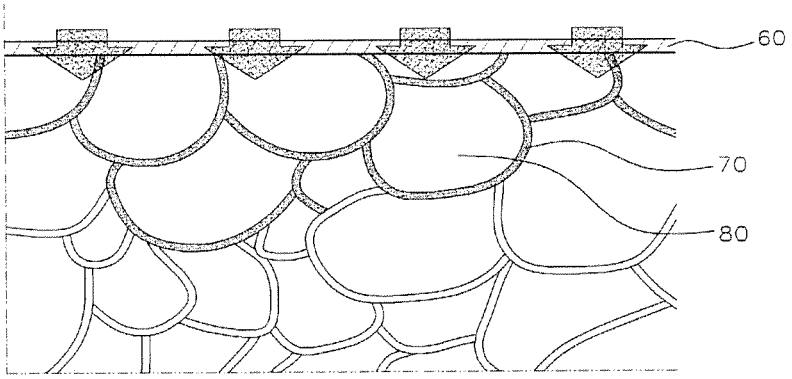
(b)
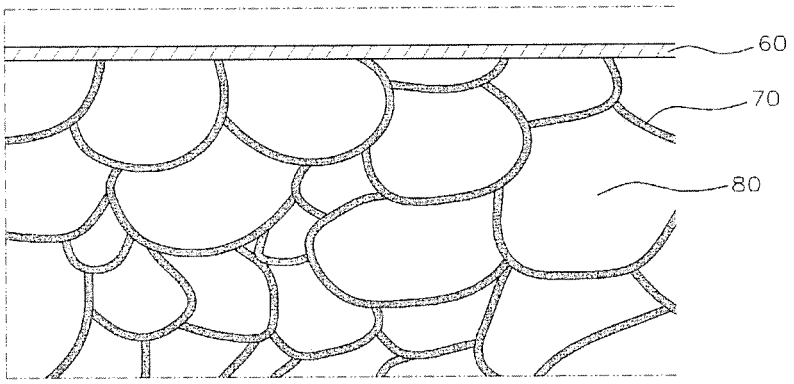
(c)

RARE EARTH PERMANENT MAGNET AND METHOD FOR MANUFACTURING THEREOF

CROSS-REFERENCE TO RELATED APPLICATION

This application claims under 35 U.S.C. § 119(a) the benefit of priority to Korean Patent Application No. 10-2015-3336, filed on Jan. 9, 2015, the entire content of which is incorporated herein by reference.

TECHNICAL FIELD

The present disclosure relates to a rare earth permanent magnet, wherein coercive force is increased while reduction of residual magnetic flux density of a sintered magnet body is inhibited by using a heat treatment for grain boundary diffusion to the inside of the sintered magnet body and at a main phase grain of the sintered magnet body, which is manufactured by mixing metal alloy powder and a rare earth compound and then coating thereof, and a method for manufacturing thereof.

BACKGROUND

In recent years, an NdFeB (Nd—Fe—B based) permanent magnet having excellent magnetic characteristics has been developed that enables high power and size reduction of a motor, and the scope of its use for various electronic appliances, electric cars, and vehicle motors is gradually increasing.

In general, magnetic characteristics of a magnet can be expressed as residual magnetic flux density and coercive force, and herein the residual magnetic flux density is determined by the fraction, density, and magnetic orientation degree of a NdFeB main phase. The coercive force is the durability of the magnetic force of a magnet caused by external magnetic field or heat, and it has a decisive relation with the microstructure of a tissue. The coercive force is determined by refining crystal grain size or homogeneous distribution on a crystal grain boundary.

In order to improve such coercive force, magnetic anisotropy energy is generally increased by adding a rare earth element such as Dy and Tb instead of Nd. But rare earth elements such as Dy and Tb are very expensive, and therefore, cause the total price of the permanent magnet to increase, and reduce the price competitiveness of the motor.

Thus, many other methods for improving the coercive force of a permanent magnet have been developed. For example, a binary alloy method for manufacturing a magnet by mixing different kinds of alloy powder having binary composition, forming a magnetic field and sintering thereof.

For example, a magnet may be manufactured by mixing Re—Fe—B powder (herein Re is rare earth) including a rare earth element such as Nd or Pr, and alloy powder. Residual magnetic flux density reduction may be inhibited when the added element of the alloy powder is distributed around the grain boundary of a Re—Fe—B crystal grain but very little of the element is on the grain boundary, thereby embodying high coercive force. However, this method has a problem in that the element of the alloy powder may diffuse into the particle when sintering. Thus, the effect may be reduced.

Recently, a method of sintering the Nd—Fe—B permanent magnet followed by diffusing a rare earth element from the magnet surface into the grain boundary has been developed, and this method is called a grain boundary diffusion method.

The grain boundary diffusion method is performed by forming a film by evaporating or sputtering a rare earth metal and the like on the Nd—Fe—B magnet surface followed by heating thereof, or by coating a rare earth inorganic compound powder on the sintered body surface followed by heating thereof. The rare earth atom deposited on the sintered body surface diffuses into the sintered body by heat treatment via a grain boundary part of the sintered body composition.

Accordingly, it is possible to concentrate the rare earth element at very high concentration on the grain boundary part or around the grain boundary part inside the sintered body main phase grain, and therefore, a more ideal tissue is formed than in the case of the binary alloy method described above. Furthermore, the magnetic characteristics reflect this tissue form, and maintenance of residual magnetic flux density and high coercive force are more notably expressed.

However, in the grain boundary diffusion method, there are many problems when using the evaporation or the sputtering method for mass production, and this may lead to decreased productivity.

In addition, the method of coating rare earth inorganic compound powder on the sintered body surface, and then heating thereof is a very simple coating process, compared to the sputtering or the evaporation method, and it has an advantage of high productivity, i.e., there is no deposition between magnets even when charging work pieces on a large scale during processing. However, there is a disadvantage in that the rare earth element diffuses by a substitution reaction between the powder and the magnet ingredients, so it is difficult to introduce them into the magnet in a large quantity.

On the other hand, a method of mixing calcium or calcium hydride powder to the rare earth inorganic compound powder and coating thereof on a magnet has also been developed, and in this method, the rare earth element is reduced by calcium reduction reaction during heat treatment and then diffused. This is an excellent method in terms of introducing the rare earth element on a large scale, but it has disadvantages in that handling of the calcium or calcium hydride powder is not easy and productivity may be lowered.

Regarding the grain boundary diffusion methods, one technique attaches the rare earth element to the NdFeB sintered magnet surface in order to prevent a reduction of coercive force, which is reduced when the NdFeB sintered magnet surface is processed for the purpose of thinning and the like, but there is a problem in that the coercive force improvement effect is insufficient.

Further, there is a technique of inhibiting irreversible demagnetization generated at high temperature by diffusing the rare earth element on the NdFeB sintered magnet surface, but this also demonstrates insufficient improvement in the coercive force.

In addition, the method of attaching the ingredients containing the rare earth element on the magnet surface by the sputtering method or the ion plating method has a disadvantage in that it is not practical due to high processing cost.

The method of coating the rare earth inorganic compound powder on the magnet base surface has an advantage of low processing cost, but it has a problem in that the degree of coercive force improvement is not very high, or the effect is not uniform. In particular, the rare earth inorganic compound prevents the diffusion of the pure rare earth element into the grain boundary diffusion, and then the rare earth inorganic compound remains inside the magnet, thereby the coercive force improvement is limited. And, processing for removing an oxidized film on the magnet surface after grain boundary diffusion has problems in that it causes a limitation on the grain boundary diffusion process such as reduction of diffusion depth, and increases the amount of processing when manufacturing a magnet.

The above information disclosed in this Background section is only for the enhancement of the understanding of the background of the disclosure and therefore it may contain information that does not form the prior art that is already known in this country to a person of ordinary skill in the art.

SUMMARY OF THE DISCLOSURE

The present disclosure has been made in an effort to solve the above-described problems associated with prior art.

One aspect of the present disclosure provides a grain boundary diffusion method, which inhibits residual magnetic flux density of a sintered magnet body and effectively improves coercive force, and a rare earth permanent magnet manufactured thereby.

Further, another aspect of the present disclosure provides a method for manufacturing a rare earth permanent magnet, which gives corrosion resistance while conducting the grain boundary diffusion method in order to minimize the amount of processing to remove an oxidized film after the grain boundary diffusion, and a rare earth permanent magnet manufactured thereby.

Other aspects of the present disclosure are not limited to the aforementioned aspects, and other non-described aspects of the disclosure will become apparent to those skilled in the art from the following description.

In one aspect, the present disclosure provides a method for manufacturing a rare earth permanent magnet, comprising steps of manufacturing an NdFeB sintered magnet. A grain boundary diffusion material is disposed on a surface of the NdFeB sintered magnet in the form of a mixed powder comprising an alloy powder containing $Re^1{}_aM_b$ or M; and $Re^2$ hydride or $Re^2$ fluoride. The grain boundary diffusion material is heated to diffuse at least one of $Re^1$, $Re^2$ and M into a grain boundary part inside the sintered magnet or a grain boundary part region of a sintered magnet main phase grain. $Re^1$ and $Re^2$ are each rare earth elements selected from the group consisting of dysprosium, terbium, neodymium, praseodymium, and holmium, M is a metal compound consisting of copper, zinc, tin, and aluminum, and $0.1<a<99.9$ and $a+b=100$.

The metal M may remain on the surface of the NdFeB sintered magnet.

The grain boundary diffusion material may contain Cu in an amount of 0.25 to 1 wt %, based on a total weight of the grain boundary diffusion material.

The step of disposing the grain boundary diffusion material on the surface of the NdFeB sintered magnet may include a spray method, a suspension adhering method, or a barrel painting method.

The step of heating the grain boundary diffusion material may include steps of a first heating of the grain boundary diffusion material to a temperature between 700 and 950° C., a first rapid cooling of the grain boundary diffusion material to room temperature, a second heating of the grain boundary diffusion material to a temperature between 480 and 520° C., and a second rapid cooling of the grain boundary diffusion material to room temperature.

The step of heating the grain boundary diffusion material may include steps of a first heating of the grain boundary diffusion material to a temperature between 700 and 950° C., a slow cooling of the grain boundary diffusion material to 600° C., a first rapid cooling of the grain boundary diffusion material to room temperature, a second heating of the grain boundary diffusion material to a temperature between 480 and 520° C., and a second rapid cooling of the grain boundary diffusion material to room temperature.

The step of a first rapid cooling of the grain boundary diffusion material to room temperature may include a temperature of the grain boundary diffusion material falling by 20° C. or more per minute.

A rare earth permanent magnet may be manufactured by disposing a grain boundary diffusion material, which is formed from a mixed powder comprising an alloy powder containing $Re^1{}_aM_b$ or M, and, $Re^2$ hydride or $Re^2$ fluoride, on a surface of a NdFeB sintered magnet. The grain boundary diffusion material is heated to diffuse at least one of $Re^1$, $Re^2$ and M into a grain boundary part inside the sintered magnet or a grain boundary part region of a sintered magnet main phase grain. $Re^1$ and $Re^2$ are each rare earth elements selected from the group consisting of dysprosium, terbium, neodymium, praseodymium, and holmium; M is a metal compound consisting of copper, zinc, tin, and aluminum; $0.1<a<99.9$, and $a+b=100$.

The $Re^2$ hydride may be $TbH_x$ or $DyH_x$, and the $Re^2$ fluoride is $TbF_x$ or $DyF_x$, where $1\leq x\leq n$.

The particle diameter of each alloy powder may be 2 to 10 μm.

The NdFeB sintered magnet may comprise, based on a total weight of the rare earth permanent magnet, 30 to 35 wt % rare earth material comprising Dy, Tb, Nd and Pr; 0 to 10 wt % transition metal comprising Co, Al, Cu, Ga, Zr and Nb; 1 wt % B; and a balance of Fe.

Other aspects and embodiments of the inventive concept are discussed infra.

It is understood that the term "vehicle" or "vehicular" or other similar term as used herein is inclusive of motor vehicles in general, such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

BRIEF DESCRIPTION OF THE DRAWINGS

The above and other features of the present inventive concept will now be described in detail with reference to certain exemplary embodiments thereof illustrated the accompanying drawings which are given hereinbelow by way of illustration only, and thus are not limitative of the present inventive concept.

FIGS. 1(*a*)-1(*c*) are exemplary views illustrating manufacturing steps of the rare earth permanent magnet according to an example of the present inventive concept.

It should be understood that the appended drawings are not necessarily to scale, presenting a somewhat simplified representation of various preferred features illustrative of the basic principles of the inventive concept. The specific design features of the present invention as disclosed herein, including, for example, specific dimensions, orientations, locations, and shapes will be determined in part by the particular intended application and use environment.

In the figures, reference numbers refer to the same or equivalent parts of the present inventive concept throughout the several figures of the drawing.

DETAILED DESCRIPTION

Hereinafter reference will now be made in detail to various embodiments of the present inventive concept, examples of which are illustrated in the accompanying drawings and described below. While the inventive concept will be described in conjunction with exemplary embodiments, it will be understood that present description is not intended to limit the inventive concept to those exemplary embodiments. On the contrary, the inventive concept is intended to cover not only the exemplary embodiments, but also various alternatives, modifications, equivalents and other embodiments, which may be included within the spirit and scope of the inventive concept as defined by the appended claims.

The present inventive concept is designed to minimize the amount of processing to remove an oxidized film after the grain boundary diffusion by applying a grain boundary diffusion method, which effectively improves coercive force while inhibiting residual magnetic flux density reduction of a sintered magnet body, and by giving corrosion resistance to a magnet by adding a metal compound consisting of Cu, Zn, Sn and Al while conducting the grain boundary diffusion process.

The grain boundary diffusion method applied to the present inventive concept will now be described. When attaching a grain boundary diffusion material 20, 30, which contains Dy or Tb on the surface of an NdFeB sintered magnet 10, and heating to 700 to 1000° C., the Dy or Tb on the magnet surface enters into the sintered magnet through the grain boundary 40 of the sintered magnet.

In the grain boundary 40 of the sintered magnet, there is a grain boundary phase called a rich phase containing higher amounts of rare earth elements. In the case of the NdFeB-based sintered magnet, the Nd-rich phase melts at a heating temperature of 700 to 1000° C. because of its lower melting temperature relative to that of the magnet particle, thereby the Dy or Tb atom is dissolved in liquid at the grain boundary 40, and diffuses from the surface of the sintered magnet 10 into the sintered magnet.

The grain boundary diffusion material 20, 30 can diffuse faster through liquid than solid, and therefore, diffusion of the Dy or Tb atom through a melted liquid-type grain boundary 70 to the inside of the grain 80 is faster than diffusion from solid grain boundary 40 to the inside of the grain 50.

Accordingly, in the present inventive concept, temperature and time of the heat treatment are set to a proper value by using the difference in grain boundary diffusion rate between the solid-type grain boundary and the liquid-type grain boundary, and thereby a high concentration of Dy or Tb can be obtained at a very near region (surface region) to the grain boundary of the main phase particle in the sintered magnet over the entire sintered magnet 10.

When the concentration of the Dy or Tb in the grain is increased through the liquid-type grain boundary, residual magnetic flux density (Br) of the magnet is reduced, but the concentration of the Dy or Tb is increased only at the surface region of each main phase particle. Thus, the residual magnetic flux density (Br) is mostly not reduced over the entire main phase particles.

Accordingly, according to the present inventive concept, a high performance magnet, which has higher coercive force (HcJ) than the NdFeB sintered magnet and whose residual magnetic flux density (Br) is not reduced, can be manufactured by employing the grain boundary diffusion method as described above.

A method for manufacturing a rare earth permanent magnet of the present inventive concept will now be described. A process of diffusing Re (Rare earth) in powder, which contains any one element selected from Dy, Tb, Nd, Pr and Ho, through the grain boundary in the NdFeB-based sintered magnet by coating the powder on the NdFeB-based sintered magnet and heating thereof. And, in order to apply the grain boundary diffusion method on the NdFeB sintered magnet surface, mixed powder formed from alloy powder 20 containing $Re^1{}_aM_b$ or M (wherein $Re^1$ is any one rare earth element selected from Dy, Tb, Nd, Pr and Ho; M is a metal compound consisting of Cu, Zn, Sn and Al; and a and b represent atom %, wherein $0.1<a<99.9$, b is balance, and $a+b=100$), and $Re^2$ hydride or $Re^2$ fluoride 30 (wherein the $Re^2$ hydride is $TbH_x$ or $DyH_x$, the $Re^2$ fluoride is $TbF_x$ or $DyF_x$, and the x is an atom number and $1\leq x\leq n$) are used as a grain boundary diffusion material 20, 30.

At least one atom of the $Re^1$, $Re^2$ and M diffuses at the grain boundary 40, 70 into the sintered magnet body 10 and the near region of the grain boundary part in the main phase grain of the sintered magnet body by heating thereof in a state that the grain boundary diffusion material 20, 30 presents on the surface of the sintered magnet body 10, and a part of the metal compound M remains on the magnet surface 60.

Furthermore, Cu contained in the metal compound M has oxidation resistance, and this may improve corrosion resistance on the magnet surface 60, and can exclude surface treatment coating after magnet processing due to the effect of surface treatment of the magnet surface with Cu during the grain boundary diffusion. In addition, Cu among the atoms constituting the metal compound M, Zn and Al has excellent binding force with the NdFeB sintered magnet and coating corrosion resistance.

On the other hand, Cu, having a relatively low melting point, may melt by heating and plays a role in reducing the $Re^2$ hydride or the $Re^2$ fluoride to the rare earth element. Thus, a high content of a pure rare earth ingredient (Dy, Tb and the like) may diffuse into the magnet grain boundary. Accordingly, NdFeB is bound to the pure rare earth ingredient (Dy, Tb and the like) on the surface of the NdFeB sintered magnet particle, and then converted to DyFeB or TbFeB and the like. The DyFeB or TbFeB has high anisotropy energy, thereby embodying high coercive force.

On the other hand, many Nd-rich phases present at the grain boundary of the sintered magnet are sites where corrosion first occurs because they are easily corroded when they are contacted by oxygen or the temperature is changed due to the low standard reduction potential of Nd.

In the present inventive concept, the grain boundary diffusion material containing Cu having a relatively low melting point diffuses into the grain boundary although it has a low melting point, and then binds to the Nd-rich phase of the grain boundary, thereby forming an NdCu rich phase compound. Thus, the standard reduction potential is increased and the effect of inhibiting corrosion can be additionally obtained.

Further, according to the present inventive concept, because the magnet surface 60 is distributed in the compound form by Cu, Zn, Sn or Al, corrosion resistance is naturally formed, and formation of the oxidized film on the magnet surface 60 is inhibited. Thus, a problem of reduction of the magnet thickness by a separate processing process to remove the oxidized film by grinding the magnet thickness can be prevented.

The NdFeB sintered magnet 10 of the present inventive concept can be in a composition where the total weight ratio of rare earth comprising Dy, Tb, Nd and Pr is 30 to 35 wt %, the total weight ratio of transition metal comprising Co, Al, Cu, Ga, Zr and Nb is 0 to 10 wt %, B is 1 wt % of, and Fe is the balance.

The method for manufacturing the NdFeB sintered magnet of the present inventive concept is as follows.

i) First, constituent materials are mixed in accordance with the previously described weight ratio of the NdFeB sintered magnet, and the mixture is dissolved by heating to 1300 to 1550° C. in a high-frequency smelting furnace, and an NdFeB alloy is manufactured using a strip cast method.

ii) Then, the NdFeB magnet alloy is crushed into coarse powder by hydrogenation and dehydrogenation, and the NdFeB alloy is finely crushed at an inert gas atmosphere using a jet mill to a size of 3 to 5 μm.

iii) Then, a molded body of the crushed NdFeB alloy is manufactured by using a magnetic field forming system wherein the magnetic field direction is perpendicular to the forming direction, and then the NdFeB sintered magnet is formed by sintering and heating the molded body in a vacuum or inert gas atmosphere.

In the processes of i), ii) and iii), the influx of impurities such as carbon and oxygen may be minimized by maintaining the inert gas or nitrogen atmosphere because magnetic characteristics of the magnet are deteriorated when impurities are contained in the sintered magnet (sintered body).

When the NdFeB sintered magnet is manufactured, the grain boundary diffusion material is attached or adhered to the NdFeB sintered magnet surface, and the mixed powder of ① the alloy powder containing the $Re^1{}_aM_b$ or M, and ② the $Re^2$ hydride or the $Re^2$ fluoride powder is used as the grain boundary diffusion material.

The $Re^2$ hydride or the $Re^2$ fluoride of the present inventive concept may contain Tb or Dy among rare earth metals, and depending on the application, it is also possible to use an alloy wherein transition metal (T) is contained with the rare earth material (Tb, Dy).

As the grain boundary diffusion material of the present disclosure, the mixed powder of the alloy powder of ① and the powder of ② may be prepared as follows.

1. Prepare a mixture of the $Re^2$ hydride (For example; $TbH_2$, $DyH_2$, $TbH_3$, $DyH_3$, TbH, DyH and the like) and the metal compound M.

2. Alloy the $Re^2$ hydride or the $Re^2$ fluoride and the metal compound M together, and then crushing thereof to form a mixed powder.

(For example, in a powder of $Re^2TCu$ or $Re^2TBCu$, the $Re^2$ may be any one selected from Dy, Tb, Nd, Pr and Ho, and in the total alloy, the $Re^2$ may be in an amount of 10 to 70 wt %. But, the content of the $Re^2$ may be higher than the total rare earth content contained in the NdFeB. The T may be a transition metal, for example Co, Ni and Fe.)

3. Heat the $Re^2$ hydride and the metal compound M at about 850° C. to make them molten or a solid solutioned ingot state, and then crushing thereof using a ball mill and the like to form a mixed powder.

The mixed powder type grain boundary diffusion material as described above may contain Cu at a concentration of 0.25 to 1%.

When the amount of Cu in the metal compound M consisting of Zn, Cu, Sn and Al is less than 0.25%, there is reduced coercive force improving effect and no corrosion resistance improving effect on the magnet surface, and when the amount of Cu is over 1%, there is a marginal improvement in corrosion resistance, but Cu penetrates to the inside of the sintered magnet particle, thereby the coercive force (HcJ) of the sintered body after grain boundary diffusion treatment becomes lower than in the case not adding Cu.

On the other hand, when the amount of Cu in the grain boundary diffusion material is 0.25 to 1%, it does not affect residual magnetic flux density of the sintered magnet because a part of Cu is coated on the magnet surface during the grain boundary diffusion process, thereby it does not affect the magnetic characteristics of the magnet.

In the present disclosure, the alloy powder 20 containing Cu may be formed at particle diameter of 2 to 10 μm, and when the particle diameter is about 2 to 3 μm, the powder has good adhesion to the magnet surface, and the surface layer after the grain boundary diffusion treatment functions as a film for preventing corrosion. Thus, coating cost can be reduced, and pretreatment cost, for example, acid washing before coating and the like, can be reduced.

If the alloy powder 20 is formed at particle diameter of 1 μm or less, the manufacturing cost may be increased and it may be easily oxidized.

And, because the powder of the metal compound M of sub μm level may be easily oxidized, the grain boundary diffusion and mixed powder treatment may be conducted in a high vacuum atmosphere ($10^{-5}$ Torr or less) or in an inert atmosphere.

FIG. 1(*a*) illustrates an image of the grain boundary diffusion materials, i.e., the alloy powder 20 and the $Re^2$ hydride or the $Re^2$ fluoride 30, which are coated on the surface of the NdFeB sintered magnet 10, and according to the present inventive concept, coating the grain boundary diffusion materials may be performed by a spray method or an adhering method using a suspension.

The adhering method using a suspension refers to a method of suspending the mixed powder of the grain boundary diffusion material in a solvent such as alcohol, immersing a magnet into the suspension, and then lifting up the magnet where the suspension is attached to the surface thereof for drying.

Further, coating the grain boundary diffusion material may be performed by a barrel painting method, and the barrel painting method is a method of forming an adhesion layer by coating an adhesive material such as liquid paraffin on the surface of the NdFeB sintered magnet, mixing the mixed powder of the grain boundary diffusion materials and metal spherule or ceramic spherule (impact media) having diameter of about 1 mm, inserting the sintered magnet into the mixture followed by vibrationally stirring thereof, thereby the mixed powder of the grain boundary diffusion materials is pushed to the adhesion layer by the impact media so the mixed powder is coated on the surface of the sintered magnet.

In the present disclosure, thickness of the grain boundary diffusion layer on the NdFeB sintered magnet surface may be 5 μm to 150 μm. When the thickness is over 150 μm, grain boundary diffusion of the grain boundary diffusion materials containing the expensive rare earth elements becomes difficult, and when thickness is less than 5 μm, the coercive force improving effect by the grain boundary diffusion treatment is not sufficient.

On the other hand, FIGS. 1(*b*) and 1(*c*) illustrate images of at least one of the $Re^1$, the $Re^2$ and the M, which is diffused to the grain boundary part into the sintered magnet or the grain boundary part region of the sintered magnet main phase grain by coating the grain boundary diffusion material on the NdFeB sintered magnet surface followed by heating thereof.

Heating during the grain boundary diffusion process may be conducted by heating the NdFeB sintered magnet coated with the grain boundary diffusion material under an inert gas or vacuum atmosphere ($10^{-5}$ torr or less) to 700 to 950° C. for 1 to 10 hours, rapidly cooling thereof to room temperature, heating thereof again to a temperature ranging from 480 to 520° C., and then rapidly cooling thereof again to room temperature.

Further, another heat treatment method of the grain boundary diffusion process of the present inventive concept can be conducted by heating the NdFeB sintered magnet coated with the grain boundary diffusion material under an inert gas or vacuum atmosphere ($10^{-5}$ torr or less) to 700 to 950° C., slowly cooling thereof up to 600° C. followed by rapidly cooling thereof to room temperature, heating thereof again to a temperature ranging from 480 to 520° C., and then rapidly cooling thereof again to room temperature.

The heat treatment of the present inventive concept is characterized by rapid cooling unlike the existing technique, and the rapid cooling may be conducted to make the temperature drop 20° C. or more per minute by injecting an inert gas such as Ar or $N_2$.

In the prior art, the heat treatment is conducted by slow cooling, not rapid cooling, where the temperature drops at about 5° C. per minute. Compared to this, the magnet of the present diclosure treated with rapid cooling shows coercive force improvement of 5% or more, because the rapid cooling inhibits the formation of an alpha phase, an impurity phase, at a range from 500 to 600° C., and grain growth deteriorating coercive force, which is generated during the slow cooling.

EXAMPLES

The following examples illustrate the inventive concept and are not intended to limit the same.

TABLE 1

| Atom | Nd | Pr | Dy | Tb | Co | B | Al | Cu | C | O | Fe |
|---|---|---|---|---|---|---|---|---|---|---|---|
| Wt % | 22 | 3 | 3 | 2 | 1 | 1 | 0.5 | 0.1 | 0.01 | 0.01 | Balance |

First, in the present disclosure, in order to confirm improvement of magnetic characteristics of a rare earth permanent magnet, an NdFeB sintered magnet was manufactured, and its ingredients and composition are as shown in the above Table 1.

TABLE 2

| | | | | Mixed Powder | Grain Boundary Diffusion Condition | | Magnetic Characteristic | | | Corrosion Resistance |
|---|---|---|---|---|---|---|---|---|---|---|
| | Sintered Magnet | Alloy Powder | Rare Earth Compound | Mixing Ratio (Weight) | Temp. (° C.) | Time (hrs) | Br (KG) | iHc (kOe) | Bhmax (MGOe) | SST (Salt Spray Test) |
| Example 1 | NdFeB | Cu | $TbH_2$ | 10:90 | 800 | 4 | 12.7 | 23.8 | 39.9 | 16 |
| Example 2 | NdFeB | Cu | $DyH_2$ | 10:90 | 800 | 4 | 12.7 | 20.8 | 39.7 | 16 |
| Example 3 | NdFeB | $Cu_{10}Dy_{90}$ | $TbH_2$ | 1:99 | 800 | 4 | 12.6 | 22.0 | 40.1 | 16 |
| Example 4 | NdFeB | $Cu_{10}Dy_{80}Co_{10}$ | $TbH_2$ | 50:50 | 800 | 4 | 12.7 | 23.5 | 39.8 | 16 |
| Example 5 | NdFeB | $Cu_{20}Dy_{80}$ | $TbH_3$ | 50:50 | 800 | 4 | 12.7 | 22.5 | 39.8 | 16 |
| Example 6 | NdFeB | $Dy_{20}Co_{30}Zn_{50}$ | $TbF_3$ | 50:50 | 800 | 4 | 12.8 | 23.5 | 39.8 | 16 |
| Comparative Example 1 | NdFeB | None | $TbH_2$ | 0:100 | 800 | 4 | 12.7 | 22.5 | 39.5 | 10 |
| Comparative Example 2 | NdFeB | None | $DyH_2$ | 0:100 | 800 | 4 | 12.7 | 20.2 | 39.5 | 10 |
| Comparative Example 3 | NdFeB | None | None | 0:100 | 800 | 4 | 12.9 | 16.5 | 40.8 | 10 |

According to the composition in Table 1, the alloy powder and the rare earth compound ($Re^2$ hydride or $Re^2$ fluoride) as a grain boundary diffusion material are coated on the formed sintered magnet, heated at 800° C. for 4 hours, and then rapidly cooled to obtain Examples 1 to 5, and magnetic characteristics thereof are as shown in Table 2.

In the above Table 2, magnetic characteristics of Comparative Examples 1 to 3, which are manufactured by not adding the alloy powder containing Cu, heating at 800° C. for 4 hours and then slowly cooling, are shown.

As shown in the above Table 2, the coercive force (Br) and residual magnetic flux density are not reduced and corrosion resistance is improved 60% or more as the result of a salt spray test (SST) in Examples 1 to 5 of the present inventive concept, compared to Comparative Examples 1 to 3.

Therefore, the present inventive concept provides a rare earth permanent magnet, which increases corrosion resistance to the magnet body, reduces addition ratio of the expensive rare earth elements, and also secures magnetic characteristics such as coercive force and residual magnetic flux density compared to existing magnets.

The rare earth permanent magnet and the method for manufacturing thereof of the present inventive concept has an effect of providing the grain boundary diffusion method, which inhibits residual magnetic flux density reduction of the sintered magnet body and also effectively improves coercive force, and the rare earth permanent magnet manufactured thereby.

Further, the present inventive concept has effects of reducing the manufacturing cost of the rare earth permanent magnet and simplifying the manufacturing process, because it gives corrosion resistance while conducting the grain boundary diffusion method, thereby minimizing the amount of processing to remove an oxidized film after the grain boundary diffusion.

Namely, the present inventive concept provides corrosion resistance to the grain boundary diffused magnet body, enhances magnetic characteristics such as coercive force and residual magnetic flux density, and also uses more inexpensive Cu, Zn, Sn and Al rather than existing materials used for the grain boundary diffusion method. Thus, it can reduce the manufacturing cost because it can reduce or replace expensive rare earth metals.

The inventive concept has been described in detail with reference to multiple embodiments thereof. However, it will be appreciated by those skilled in the art that changes may be made in these embodiments without departing from the principles and spirit of the inventive concept, the scope of which is defined in the appended claims and their equivalents.

What is claimed is:

1. A method for manufacturing a rare earth permanent magnet, comprising steps of:

manufacturing an NdFeB sintered magnet;

disposing, on a surface of the NdFeB sintered magnet, a grain boundary diffusion material in the form of a mixed powder comprising an alloy powder containing $Re^1{}_aM_b$ and $Re^2$ hydride; and heating the grain boundary diffusion material to diffuse at least one of $Re^1$, $Re^2$, and M into a grain boundary part inside the sintered magnet or a grain boundary part region of a sintered magnet main phase grain, where $Re^1$ and $Re^2$ are each rare earth elements selected from the group consisting of dysprosium, terbium, neodymium, praseodymium, and holmium, M is one or more metal compounds selected from the group consisting of copper, zinc, tin, and aluminum, $0.1<a<99.9$, and $a+b=100$, where a and b represent atom %, wherein the grain boundary diffusion material contains Cu in an amount of 0.25 to 1 wt %, based on a total weight of the grain boundary diffusion material, and the alloy powder containing Cu is formed at particle diameter of 2 to 10 μm, and wherein the disposed grain boundary diffusion material forms a layer and the thickness of the layer is 5 μm to 150 μm.

2. The method for manufacturing a rare earth permanent magnet of claim 1, wherein the M remains on the surface of the NdFeB sintered magnet.

3. The method for manufacturing a rare earth permanent magnet of claim 1, wherein the step of disposing the grain boundary diffusion material on the surface of the NdFeB sintered magnet includes a spray method, a suspension adhering method, or a barrel painting method.

4. The method for manufacturing a rare earth permanent magnet of claim 1, wherein the step of heating the grain boundary diffusion material includes steps of first heating of the grain boundary diffusion material to a temperature between 700 and 950° C., first cooling of the grain boundary diffusion material to room temperature, second heating of the grain boundary diffusion material to a temperature between 480 and 520° C., and second cooling of the grain boundary diffusion material to room temperature, wherein the first and second cooling rate is 20° C. or more per minute.

5. The method for manufacturing a rare earth permanent magnet of claim 1, wherein the step of heating the grain boundary diffusion material includes steps of first heating of the grain boundary diffusion material to a temperature between 700 and 950° C., cooling of the grain boundary diffusion material to 600° C. with the cooling rate about 5° C., per minute, first cooling of the grain boundary diffusion material to room temperature, second heating of the grain boundary diffusion material to a temperature between 480 and 520° C., and second cooling of the grain boundary diffusion material to room temperature, wherein the first and second cooling rate is 20° C. or more per minute.

* * * * *